United States Patent [19]

Sabranski et al.

[11] Patent Number: 4,537,132

[45] Date of Patent: Aug. 27, 1985

[54] HOLLOW-CHARGE INSERT FOR ARMOR-PIERCING PROJECTILE

[75] Inventors: Udo Sabranski, Willich; Hans Orth, Ratingen, both of Fed. Rep. of Germany

[73] Assignee: Rheinmetall GmbH, Dusseldorf, Fed. Rep. of Germany

[21] Appl. No.: 920,621

[22] Filed: Jun. 19, 1978

[30] Foreign Application Priority Data

Jun. 30, 1977 [DE] Fed. Rep. of Germany ..... 27295176

[51] Int. Cl.[3] ..... F42B 1/02

[52] U.S. Cl. ..... 102/307; 102/309; 102/476

[58] Field of Search ..... 102/20, 24 HC, 56 SC, 102/306–310, 476

[56] References Cited

U.S. PATENT DOCUMENTS 3,217,647 11/1965 Thomanek ..... 102/20

3,478,685 11/1969 Thomanek et al. ..... 102/24 HC 3,732,816 5/1973 Müller ..... 102/24 HC

FOREIGN PATENT DOCUMENTS 1037819 5/1953 France ..... 102/56 SC

*Primary Examiner*—Peter A. Nelson

*Attorney, Agent, or Firm*—Karl F. Ross; Herbert Dubno

[57] ABSTRACT

A forwardly concave insert for a hollow charge of an armor-piercing missile or projectile has an inner peripheral wall with linear generatrices and an outer peripheral wall with at least partly curved generatrices diverging from the inner wall surface to an annular zone of maximum wall thickness at more than half the distance from the point of the cone to its base, the outer generatrices having centers of curvature lying beyond the cone axis on radii which are perpendicular to the inner wall surface at that annular zone. The arcuately curved sections of these outer generatrices merge tangentially into substantially straight-line sections converging at the cone axis into the aforementioned point.

8 Claims, 1 Drawing Figure

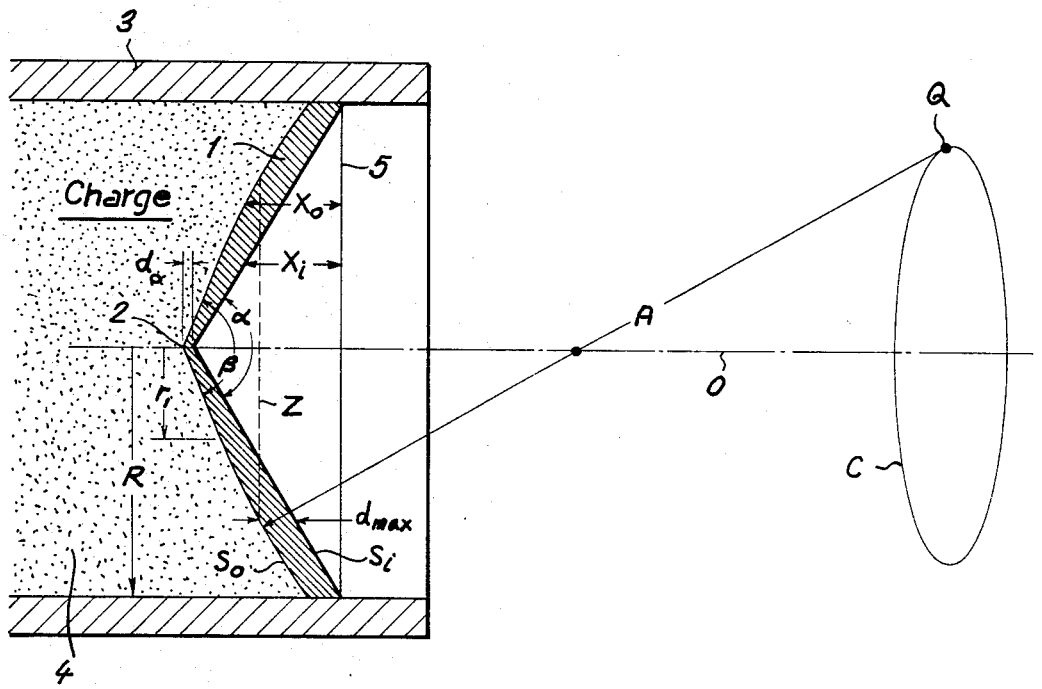
3
1
5
Charge
$X_o$
$X_i$
$d_\alpha$
2
α
β
$r_i$
Z
R
$d_{max}$
$S_o$
$S_i$
4
Q
A
O
C

HOLLOW-CHARGE INSERT FOR ARMOR-PIERCING PROJECTILE

FIELD OF THE INVENTION

Our present invention relates to an insert for a hollow charge of an armor-piercing projectile, originally of generally hollow-conical configuration, designed to be collapsed by the detonation of a surrounding charge into an elongate dart capable of penetrating the shell of an armored vehicle or the like.

BACKGROUND OF THE INVENTION

Inserts of this type have been disclosed, for example, in U.S. Pat. Nos. 3,217,647 and 3,732,816. Their wall thickness changes in a progressive manner, usually increasing from the rearwardly facing point to the forwardly facing base of the hollow cone, with straight or curvilinear generatrices defining their inner and outer peripheral surfaces.

Such hollow-charge inserts do not always fulfill their desired purpose, particularly if the surrounding casing (whose wall thickness is necessarily limited) ruptures during the detonation of the charge with resulting weakening of the inwardly acting forces in the vicinity of the cone base. Since the parts of the insert near this base are designed to form the penetration point of the collapsed dart-shaped insert, the effectiveness of the device may be seriously impeded in such an instance.

OBJECT OF THE INVENTION

The object or our present invention, accordingly, is to provide an improved hollow-charge insert of the general type set forth which obviates this drawback.

SUMMARY OF THE INVENTION

In accordance with our present invention, the inner peripheral surface of the insert seated in a casing with a substantially cylindrical wall portion is a cone with an obtuse vertex angle, preferably of about 120° to 125°, whereas the outer peripheral surface has curvilinear generatrices with a center of curvature lying in the axial plane of the respective generatrice beyond the cone axis; the locus of the centers of curvature of all the generatrices of this outer surface is a circle centered on the cone axis, and the maximum wall thickness occurs in an annular zone whose distance from the base of the cone adjacent the casing wall is less than its distance from the point thereof. At a location between this annular zone and the point, the generatrices flatten out so that their radii of curvature increase, to infinity in a limiting but preferred case.

BRIEF DESCRIPTION OF THE DRAWING

The above and other features of our invention will now be described in detail with reference to the accompanying drawing the sole FIGURE of which diagrammatically illustrates, in axial section, a hollow charge with an insert representing a preferred embodiment.

SPECIFIC DESCRIPTION

In the drawing we have shown part of a cylindrical casing 3, similar to one shown in commonly owned U.S. Pat. No. 3,732,816 referred to above, containing an insert 1 according to our present improvement backed by an explosive charge 4. Insert 1 is generally in the shape of a hollow frustocone, with a point 2 and a base 5.

Insert 1 has an inner peripheral surface $S_i$ of conical shape, with straight-line generatrices, having a vertex angle $\alpha=122°$. Its outer peripheral surface $S_o$ has generatrices which are straight lines in the vicinity of point 2, including a vertex angle $\beta=135°$; at a radius $r_1$ measured from the cone axis O, these straight generatrices merge tangentially into planar curves whose radii of curvature A intersect the cone axis O, originating at a center Q which lies on a circle C transverse to that axis. The thickness d of the cone wall has its minimum value $d_o$ at the point 2 and increases progressively from there to an annular zone Z where the radius of curvature A is perpendicular to the inner surface $S_i$, decreasing beyond that zone to the rim of the base 5 where, however, the axial wall thickness is still substantially larger than $d_o$.

The magnitude of the radius $r_1$, defining the transition zone between the straight-line and curved sections of the outer generatrices, lies preferably between about 0.4R and 0.5R. The radius of curvature A may range between substantially 4.5R and 5.5R.

The distance $x_i$ of any point on the inner surface $S_i$ from the base plane is given by $$x_i=\cot \alpha/2(R-r).$$

The corresponding distance $x_o$ for the outer surface $S_o$ is given for the area from $r=0$ to $r=r_1$ by $$x_o'=R\cdot\cot \alpha/2+d_o-r\cdot\cot \beta/2$$

and for the area from $r=r_1$ to $r=R$ by $$x_o''=\sqrt{A^2-\left[r-\left(r_1-A\cos\frac{\beta}{2}\right)\right]}+R\cdot\cot\frac{\alpha}{2}-r_1\cdot\cot\frac{\beta}{2}-A\cdot\sin\frac{\beta}{2}+d_o.$$

The thickness d of the insert, measured in the axial direction, is given in the first area by $x_o'-x_i$ and in the second area by $x_o''-x_i$.

The foregoing numerical values are particularly useful with spin-stabilized projectiles, though they could also be applied to those of the wing-stabilized type. Changes in the shape of the dart produced by the collapse of the insert, upon detonation with ruptured casing, may affect the axial positioning of the deflected cone portions but do not detrimentally affect the armor-piercing action thereof.

It will be apparent that the transition zone between the tangentially merging straight-line and curvilinear sections of the generatrices of outer surface $S_o$ lies at substantially the same distance from the annular zone Z of maximum thickness $d_o$ as separates the latter zone from the rim of surface $S_o$.

We claim:

1. In an armor-piercing projectile having a casing with a substantially cylindrical wall portion, an insert of generally hollow-frustoconical shape in said casing with a rearwardly facing point on the axis of said wall portion and a forwardly facing base adjoining said wall portion, and a charge behind said insert in said casing, the improvement wherein said insert has an inner peripheral surface of conical shape with an obtuse vertex angle and straight-line generatrices and an outer peripheral surface of generally conical shape whose axial distance from said inner surface progressively from a minimum value at said point to a maximum value in a predetermined annular zone and thereafter decreases to a value greater than said minimum value at said base.

2. The improvement defined in claim 1 wherein said annular zone lies closer to said base than to said point.

3. The improvement defined in claim 2 wherein said outer surface has generatrices with curvilinear sections which are substantially arcuate, in respective axial planes, about centers each lying on a radius which passes from said zone perpendicularly to said inner surface and intersects said axis, the locus of said centers being a circle transverse to said axis.

4. The improvement defined in claim 3 wherein the generatrices of said outer surface flatten out at a transition zone whose distance from said annular zone substantially equals the distance of said annular zone from the rim of said outer surface.

5. The improvement defined in claim 4 wherein the generatrices of said outer surface have straight-line sections merging tangentially into said curvilinear sections at said transition zone.

6. The improvement defined in claim 4 or 5 wherein said vertex angle ranges between substantially 120° and 125°.

7. The improvement defined in claim 4 or 5 wherein the length of said radius ranges between substantially 4.5 and 5.5 times the radius of said insert at said base.

8. The improvement defined in claim 4 wherein said transition zone lies at a distance from said axis ranging between substantially 0.4 and 0.5 times the radius of said insert at said base.

* * * * *